United States Patent [19]

Hayasaka

[11] Patent Number: 4,956,895

[45] Date of Patent: Sep. 18, 1990

[54] REMOVABLE CLIP FOR PORTABLE EQUIPMENT

[75] Inventor: Sigeki Hayasaka, Tokyo, Japan

[73] Assignee: NEC Corporation, Tokyo, Japan

[21] Appl. No.: 418,749

[22] Filed: Oct. 4, 1989

Related U.S. Application Data

[63] Continuation of Ser. No. 138,403, Dec. 28, 1987, abandoned.

[30] Foreign Application Priority Data

Dec. 25, 1986 [JP] Japan ..... 61-201952[U]

[51] Int. Cl.[5] ..... A45F 5/02

[52] U.S. Cl. ..... 24/3 J; 24/3 R; 224/252

[58] Field of Search ..... 24/3 J, 3 R, 3 F, 3 L, 24/3 H; 224/252, 269, 247

[56] References Cited

U.S. PATENT DOCUMENTS

| | | | |
|---|---|---|---|
| 668,088 | 2/1901 | Bruce | 24/3 R |
| 1,214,161 | 1/1917 | Hettinger et al. | 224/252 |
| 2,006,773 | 7/1935 | Moore et al. | 224/252 |
| 3,956,701 | 5/1976 | James, Jr. et al. | 224/252 |
| 4,083,481 | 4/1978 | Selinko | 224/252 |
| 4,111,343 | 9/1978 | Selinko | 24/3 J |
| 4,536,925 | 8/1985 | Boothe et al. | 24/3 J |
| 4,605,335 | 8/1986 | Otrusina | 224/269 |
| 4,635,836 | 1/1987 | Mooney et al. | 224/252 |

*Primary Examiner*—Victor N. Sakran

*Attorney, Agent, or Firm*—Sughrue, Mion, Zinn, Macpeak & Seas

[57] ABSTRACT

A butterfly clip removably mounted on a paging receiver or like portable equipment is made up of a support section which comprises a molding of plastics, and a clip section constantly biased by a coil spring, which is received in the support section, and openably held by the support section through a spring pin. The support section is shaped complementary to the contour of the equipment. The housing of the equipment is formed with a slit-like recess on its top and a generally L-shaped recess adjacent to its lower end. On the other hand, the support section of the clip is provided with projections at the top of its inner wall which mates with the recess provided on the top of the housing, and a generally J-shaped metal member at its lower end which mates with the recess provided in the lower portion of the housing. The clip is easily attached to and detached from the housing by, respectively, mating the metal member of the support section with the recess of the housing and removing the support member from the housing using the elasticity of plastics.

5 Claims, 4 Drawing Sheets

REMOVABLE CLIP FOR PORTABLE EQUIPMENT

This is a continuation of application Ser. No. 138,403, filed 12-28-87, now abandoned.

BACKGROUND OF THE INVENTION

The present invention relates to a butterfly clip applicable to a paging receiver and other portable equipment and, more particularly, to a mounting structure which allows a removable clip to be readily mounted to the housing of a paging receiver and others and has reliable mechanical strength.

As regards a paging receiver or pager, for example, a person in most cases puts it on his or her waist belt and, hence, a butterfly clip or the like is fitted on the housing of the pager. Specifically, a projection is molded in plastics integrally with the back of the pager housing to define a pocket-like seat for accommodating a coil spring therein, which is adapted to mount the butterfly clip. The butterfly clip is constantly biased by the coil spring, and is rotatable about a spring pin which is associated with the coil spring. To put the clip on the waist belt of a person who carries the receiver, the clip is opened by hand against the action of the coil spring so as to nip the belt.

A problem with the above-stated mounting structure is that when one desires to use the pager putting it in the breast pocket or in a bag, i.e., without using the butterfly clip, the clip simply constitutes an obstacle. Even if the clip is removed from the pager housing, the previously mentioned seat which protrudes from the back of the housing is not only cumbersome when the pager is held by hand, but also detrimental to the appearance of the pager.

A solution to the problem stated above is to allow the clip to be removed bodily from the pager housing. The present invention is contemplated to implement such a solution.

While a case made of leather or a holder made of plastics is sometimes used in place of a clip, it is greater in dimensions than the receiver itself and, therefore, contradictory to the trend of the miniaturization of a receiver.

SUMMARY OF THE INVENTION

It is, therefore, an object of the present invention to provide a removable clip applicable to a wide variety of portable equipment such as a paging receiver.

It is another object of the present invention to provide a butterfly clip applicable to a paging receiver and other various kinds of portable equipment and efficiently operable.

It is another object of the present invention to provide a butterfly clip applicable to a paging receiver and other various kinds of portable equipment, and which does not degrade the appearance of the equipment when removed.

It is another object of the present invention to provide a generally improved removable clip for portable equipment.

In accordance with the present invention, there is provided a structure for removably mounting a clip to portable equipment, the clip having a support member which is shaped complementary to the back of a housing of the equipment and a clip member constantly biased by a spring toward the back of the housing. The structure comprises a first mating portion provided on the top of the housing of the equipment, a second mating portion provided in a lower portion of the back of the housing, a third mating portion provided on the top of the support member of the clip for mating with the first mating portion, and a fourth mating portion provided at the lower end of the support member for mating with the second mating portion.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENT

Figure 1:
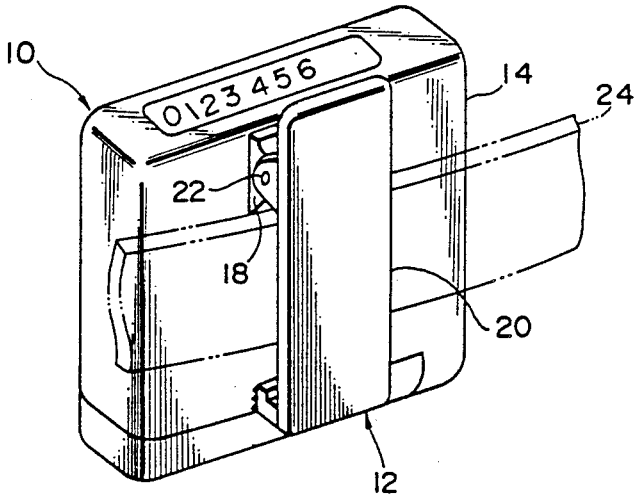
FIG. 1 PRIOR ART
FIG. 1 is a perspective view of a prior art butterfly clip which is applied to a paging receiver.
Figure 2:
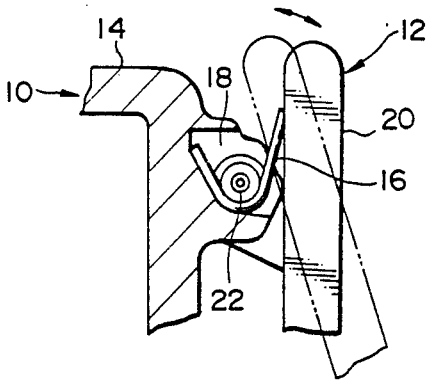
FIG. 2 PRIOR ART
FIG. 2 is a fragmentary section showing the prior art clip of FIG. 1;.
Figure 3:
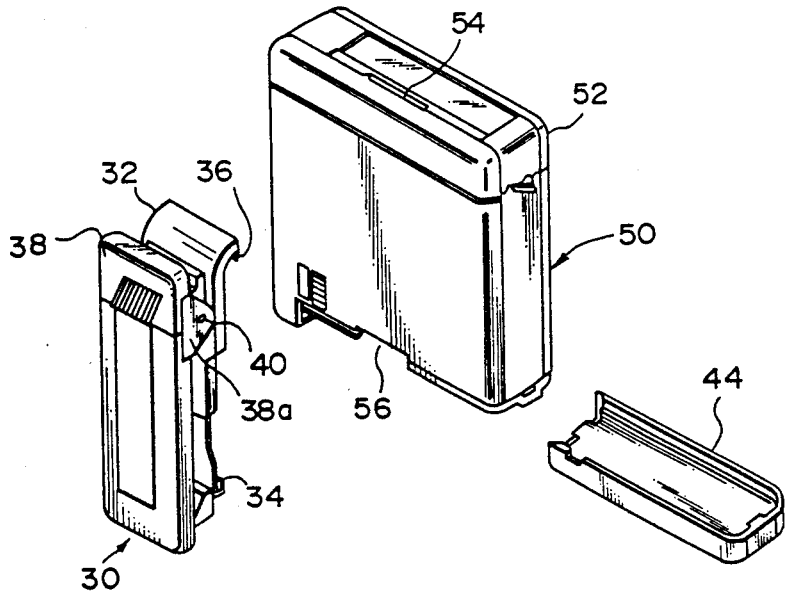
FIG. 3 is a perspective view of a removable clip embodying the present invention and a paging receiver to which the clip is applicable.
Figure 4:
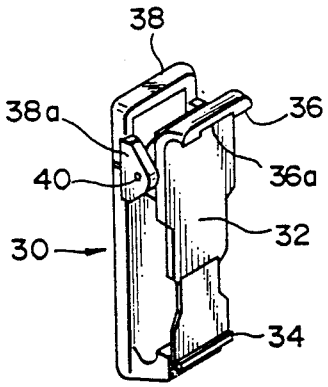
FIG. 4 is a perspective view of the clip of FIG. 3 as seen from the other side.

To better understand the present invention, a brief reference will be made to a prior art clip, shown in FIGS. 1 and 2. The prior art clip, generally 12, is shown as being applied to a paging receiver 10. A pocket-like seat 18 is molded of plastic integrally with a part of the back of a housing 14 of the paging receiver, or pager, 10. A coil spring 16 is received in the pocket-like seat 18. A clip section 20 of the clip 12 is constantly biased by the coil spring 16 and openable about a pin 22, FIG. 2, against the action of the spring 16. A person may put the pager 10 on his or her waist belt 24 or the like by opening the clip 12 so as to nip the belt 24. As previously stated, the clip 12 cannot be removed easily from the receiver housing 14 and, if removed, leaves the seat 18 bulging outward from the housing 14 simply constituting an obstacle and, thereby, degrading the efficient use.

Referring to FIGS. 3 to 7, a removable clip 30 embodying the present invention is shown together with a pager 50, exemplary portable equipment to which the present invention is applicable. As shown, the pager 50 is provided with a slit-like recess 54, FIGS. 3 and 6, on the top and a recess 56 having a generally "L" section adjacent to the lower end of the back. The removable clip 30 includes a support section 32 which is shaped complementary to the contour of the pager housing 52. A generally J-shaped metal member 34 is provided integrally with the lower end of the support section 32 which is implemented with a molding of plastics. The metal member 34 is so shaped as to mate with the L-shaped recess 56 of the pager housing 52. Projection 36 extends from the top of the inner wall of the support section 32 and individually mates with the recess 54 of the pager housing 52. A recess **36*a* is defined between the projections 36**. With this configuration, the support section 32 which forms a part of the clip 30 can be mounted readily and firmly on the pager housing 52.

A clip section 38 is to be held by the support section 32 includes ribs 38*a* each being formed with an aperture which allows a spring pin 40 to be press-fitted therein. The support section 32 is provided with a pocket-like projection on its back, and this projection is formed also with an aperture in alignment with the apertures of the ribs 38*a* for receiving the spring pin 40. In this construction, the clip section 38 is retained by the support section 32. A coil spring 42 is received in the projection of the support section 32 to biased constantly the clip section 38, so that the clip 30 may be opened and closed only when the clip section 38 is held by hand. The reference numeral 44 designates a battery casing of the pager 50.

Figure 5:
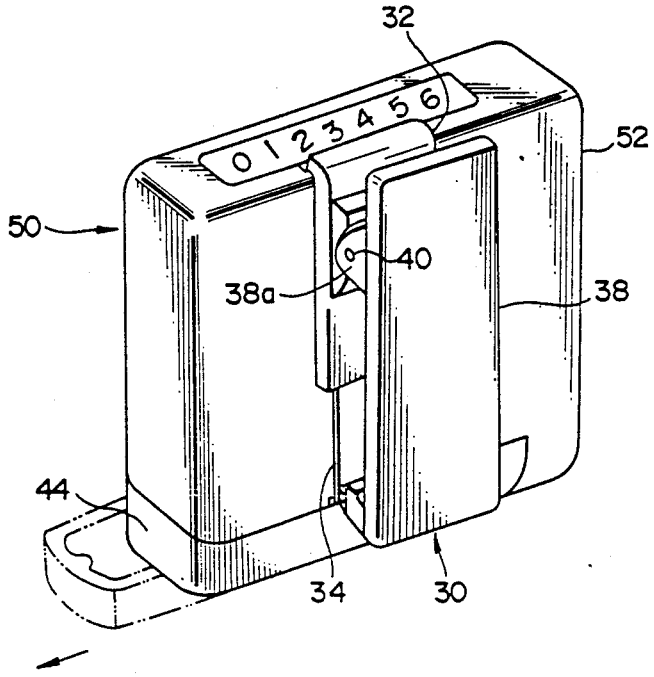
FIG. 5 is a perspective view of the clip of FIGS. 3 and 4 which is fitted on the paging receiver.
Figure 6:
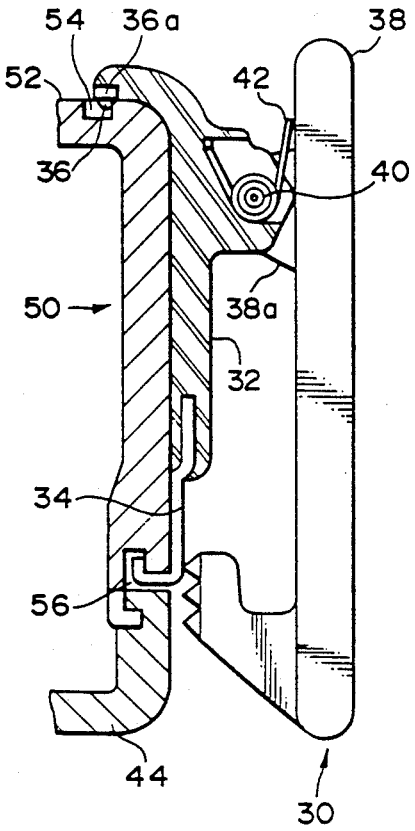
FIG. 6 is a sectional side elevation showing the clip and receiver in the condition of FIG. 5.

To attach the clip 30 to the pager 50, the J-shaped metal member 34 of the support section 32 is mated with the L-shaped recess 56 of the pager housing 52 and, then, the projections 36 of the support section 32 are mated with the recess 54 of the pager housing 32. Finally, the battery cover 44 is slid into the pager housing 52 to retain firmly the metal member 34 of the support section 32. FIGS. 5 and 6 show the clip 30 which is mounted on the pager 50.

Figure 7:
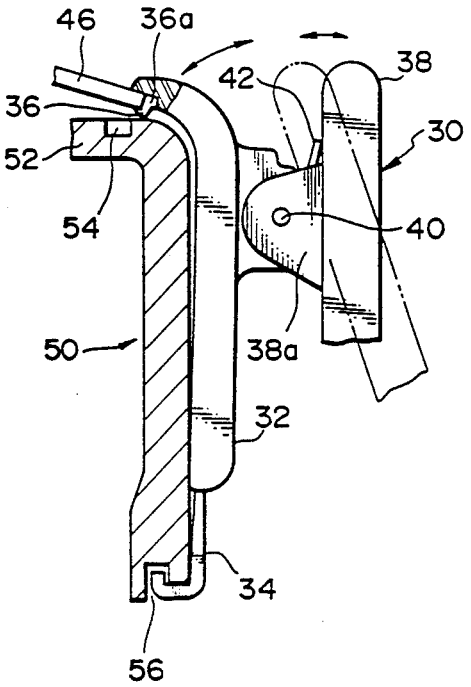
FIG. 7 sectional side elevation showing how the clip in the condition shown in FIG. 5 is removed.

To remove the clip 30 from the pager 50 as desired by the user, as shown in FIG. 7, the support section 32 is raised by, for example, a coin 46 or the nail of a finger. This causes the support section 32 to deform due to elasticity until the projections 36 of the support section 32 become released from the recess 36 of the pager housing 52, the clip 30 thus being removed from the pager 50. To remove fully the clip 30 from the pager housing 52, the battery cover 44 fitted to the bottom of the pager housing 52 is slid sideways to uncover the L-shaped recess 56 of the housing 52, then the upper portion of the support section 32 is released from the housing 52 as stated above, and then the support section 32 is slid downward to release the lower portion thereof from the housing 52.

It is to be noted that the present invention is applicable not only to a paging receiver as shown and described, but also to other various kinds of portable equipment.

In summary, it will be seen that the present invention provides a clip for portable equipment which is easy to attach to and detach from the equipment as desired and, when detached, leaves no projection on the housing of the equipment which would be unpleasant with regard to both the tactile sense and the appearance. This advantage is derived generally from a unique construction in which a support section of the clip is molded in plastics independently of a clip section, and the clip section is biased by a coil spring, which is received in the support section, and retained by the support section through a spring pin.

Various modifictions will become possible for those skilled in the art after receiving the teachings of th present disclosure without departing from the scope thereof.

What is claimed is:

1. A structure for removably mounting a clip to portable equipment, said clip having a molded plastic support member which is shaped complementary to a back of a housing of said equipment and a clip member constantly biased by a spring toward said back of said housing, said structure comprising:
   - a first, plastic mating portion provided on a top of said housing of said equipment;
   - a second mating portion provided on said back of said housing;
   - a third mating portion provided on a top of said support member of said clip for mating with said first mating portion; and
   - a fourth, metal mating portion buried in a lower end of said support member for mating with said second mating portion.

2. A structure as claimed in claim 1, wherein each of said first and second mating portions comprises a slit-like recess while each of said third and fourth mating portions comprises a projection which mates with said recess.

3. A structure as claimed in claim 2, wherein said slit-like recess constituting said second mating portion is generally L-shaped.

4. A structure as claimed in claim 2, wherein said projection constituting said third mating section is provided with a recess at a substantially intermediate portion thereof.

5. A structure as claimed in claim 2, wherein said fourth mating portion has a generally J-shaped cross-section.

* * * * *